US010974873B2

(12) United States Patent
Lee

(10) Patent No.: US 10,974,873 B2
(45) Date of Patent: Apr. 13, 2021

(54) SEALING CAP OF POWDER CONTAINER

(71) Applicant: Zero to Seven Inc., Seoul (KR)

(72) Inventor: Choong Ha Lee, Seoul (KR)

(73) Assignee: ZERO TO SEVEN INC., Seoul (KR)

( * ) Notice: Subject to any disclaimer, the term of this patent is extended or adjusted under 35 U.S.C. 154(b) by 19 days.

(21) Appl. No.: 16/395,362

(22) Filed: Apr. 26, 2019

(65) Prior Publication Data

US 2020/0062460 A1 Feb. 27, 2020

(30) Foreign Application Priority Data

Aug. 27, 2018 (KR) ..... 10-2018-0100528
Feb. 8, 2019 (KR) ..... 10-2019-0014841

(51) Int. Cl.
*B65D 41/48* (2006.01)
*B65D 43/02* (2006.01)

(52) U.S. Cl.
CPC ..... *B65D 41/485* (2013.01); *B65D 43/0212* (2013.01); *B65D 2251/20* (2013.01)

(58) Field of Classification Search
CPC ..... B65D 41/485; B65D 43/0212; B65D 2251/20; B65D 83/06; B65D 53/08; B65D 17/502
USPC ..... 220/258.1–258.2, 270, 359.1–359.4; 215/232
See application file for complete search history.

(56) References Cited

U.S. PATENT DOCUMENTS

2003/0075544 A1* 4/2003 Turner ..... B21D 51/38 220/269
2007/0272693 A1 11/2007 Richards

FOREIGN PATENT DOCUMENTS

EP 2517973 A1 10/2012
KR 101791410 B1 11/2017
WO WO0110731 A1 2/2001

OTHER PUBLICATIONS

First Examination Report from New Zealand Intellectual Property Office of 752541, dated Sep. 11, 2019.
The extended European Search Report of 19170736.3, dated Nov. 6, 2019, English translation.

* cited by examiner

*Primary Examiner* — James N Smalley
(74) *Attorney, Agent, or Firm* — STIP Law Group. LLC

(57) ABSTRACT

Disclosed is a sealing cap comprising: a cover part having an opening formed therein; and a sealing part having a sealing body and a pulling part formed therein, wherein the sealing body is attached to an upper surface of the cover part and covers the opening to seal the opening, wherein the pulling part is formed at one point on an outer edge of the sealing body to extend, and folded by being bent toward an upper surface of the sealing body to thereby overlap the sealing body, wherein a mounting groove is formed at a portion of the sealing body overlapping the pulling part, and wherein, the pulling part is inserted into the mounting groove such that at least a portion of an upper surface of the pulling part is placed at a position lower than a position of a plane formed by the upper surface of the sealing body.

9 Claims, 13 Drawing Sheets

SEALING CAP OF POWDER CONTAINER

CROSS-REFERENCE TO RELATED APPLICATIONS

This application claims the priority of the Korean Patent Applications No. 10-2018-0100528 filed on Aug. 27, 2018 and No. 10-2019-0014841 filed on Feb. 8, 2019, in the Korean Intellectual Property Office, the disclosure of which is incorporated herein by reference.

BACKGROUND OF THE INVENTION

Field of the Invention

The present invention relates to a sealing cap of a powder container, and more particularly to a sealing cap of a power container, the cap capable of stably sealing the powder container filled with powder and preventing a tab of the sealing cap from being torn apart or separated by an external device in the course of sealing and conveying the powder container.

Related Art

An existing powder container for storing a certain amount of powder-type filing such as formula is comprised of: a cover part coupled to an upper side of the powder container and having an opening formed thereon; a sealing part attached to an upper surface of the cover part to seal the opening; and a pulling part (or a tab) extending from one end of the sealing part and bent toward the other side of the sealing part form one end of the sealing part to overlap the upper surface of the sealing part.

Meanwhile, a conveyer belt is used conventionally to fill the powder container with power and assembly and convey the powder container. However, since the pulling part bent to overlap the upper surface of the sealing part is not stably fixed to the upper surface of the sealing part, a bent portion is lifted up or pulled and torn apart by an external device in the course of assembling and conveying of the powder container. As a result, the bent portion can be separated from the sealing part and hence open the opening, thereby leaking powder from the powder container.

In order to solve this problem, a method of bonding the pulling part to the upper surface of the sealing part using adhesive or the like has been suggested. Yet, this method requires an additional process to bond the pulling part using adhesive or the like, and a manufacturing cost increases due to the use of adhesive. In addition, a method of fixing one end of the pulling part to the sealing part has been introduced, but this method requires an additional process to fix one end of the pulling part to the sealing part and increases complexity of a fixing technique.

PRIOR ART DOCUMENT

Patent Document (Patent Document 001) Korean Patent Registration No. 10-1791410

SUMMARY OF THE INVENTION

In order to solve the above problem, the present invention provides a sealing cap of a powder container, the cap capable of stably fixing a pulling part to a sealing part, without being separated therefrom, when filling powder in the powder container and assembling and conveying the powder container.

In one embodiment, there may be provided a sealing cap including: a cover part coupled to an upper side of a powder container and having an opening formed therein; and a sealing part having a sealing body and a pulling part formed therein, wherein the sealing body is attached to an upper surface of the cover part and covers the opening to seal the opening, wherein the pulling part is formed at one point on an outer edge of the sealing body to extend, and folded by being bent toward an upper surface of the sealing body to thereby overlap the sealing body, wherein a mounting groove recessed toward an inner space of the powder container is formed at a portion of the sealing body overlapping the pulling part, and wherein, when the pulling part is folded, the pulling part is inserted into the mounting groove such that at least a portion of an upper surface of the pulling part is placed at a position lower than a position of a plane formed by the upper surface of the sealing body.

In another aspect, the mounting groove may be comprised of an open upper surface, a side surface, and a bottom surface, and a shape of the bottom surface may correspond to a shape of the pulling part.

In yet another aspect, the mounting groove may be recessed toward the inner space of the powder container in a direction from one end to the other end of an edge of the opening, and the mounting groove may include: a downward slope bottom surface in which a recess depth becomes greater in the direction from one end to the other end of the edge of the opening; and a parallel bottom surface in which a recess depth is maintained constant.

In yet another aspect, while the pulling part is spaced apart from the bottom surface of the mounting groove, the pulling part may extend in a downward inclined direction toward the bottom surface.

In yet another aspect, a flange portion may be formed in the cover part along the edge of the opening, and a periphery of a lower surface of the sealing body may be attached to the flange portion.

In yet another aspect, the pulling part may be bent on an outer side edge of the sealing body, pressed by the sealing body at a portion where the pulling part overlaps the flange portion, and positioned inside the mounting groove in a downward extending area continuing after the portion where the pulling part overlaps the flange portion.

In yet another aspect, a cut-off portion may be formed on both sides of the pulling part on the outer side edge of the sealing body, the cut-off portion which is cut off partially in an inward direction.

In yet another aspect, the pulling part may be in a shape of a ring having a hold hole formed therein.

In yet another aspect, the sealing cap may further include a first finishing part that is formed by being bent downward from the cover part along the edge of the opening.

In yet another aspect, the first finishing part may be comprised of a downward portion bent downward from the edge of the opening, and a support portion bent outward of the opening from a lower end of the downward portion, and, when a plurality of sealing caps is deposited, the support portion may be brought into contact with a periphery of a sealing part of a lower sealing cap positioned under the sealing cap and thereby supported by the periphery of the sealing part of the lower sealing cap.

In yet another aspect. a bottom surface of the mounting groove may be placed at a position higher than a position of a lower surface of the first finishing part.

In yet another aspect, the sealing cap may further include a second finishing part that is formed by being bent downward from one portion on an edge of the cover part along the edge of the cover part.

In yet another aspect, a height of the second finishing part may be equal to or greater than a height of the mounting groove.

In yet another aspect, when a plurality of sealing caps is deposited, an end of the second finishing part may be brought into contact with a periphery of a lower sealing cap positioned under the sealing cap and thereby supported by the periphery of the lower sealing cap.

In yet another aspect, embo-shape forming processing may have been performed on a portion of an area of the sealing body overlapping the opening.

In yet another aspect, there may be provided a sealing cap including: a cover part coupled to an upper side of a powder container and having an opening formed therein; and a sealing part having a sealing body and a pulling part formed therein, wherein the sealing body is attached to an upper surface of the cover part and covers the opening to seal the opening, wherein the pulling part is formed at one point on an outer edge of the sealing body to extend, and folded by being bent toward an upper surface of the sealing body to thereby overlap the sealing body, wherein a mounting groove recessed toward an inner space of the powder container is formed at a portion of the sealing body overlapping the pulling part, and wherein the pulling part is inserted into the mounting groove.

In yet another aspect, the cover part and the sealing part may be in a circular shape.

In yet another aspect, a first support portion may be formed to be projected downward along an inner edge of a lower surface of the cover part.

In yet another aspect, while the pulling part is spaced apart from the bottom surface of the mounting groove, the pulling part may extend downward toward a bottom surface of the mounting groove.

In yet another aspect, the sealing body may be attached between a circular-shaped attachment line surrounding an inner edge of the cover part and the inner edge.

DESCRIPTION OF EXEMPLARY EMBODIMENTS

Figure 1A:
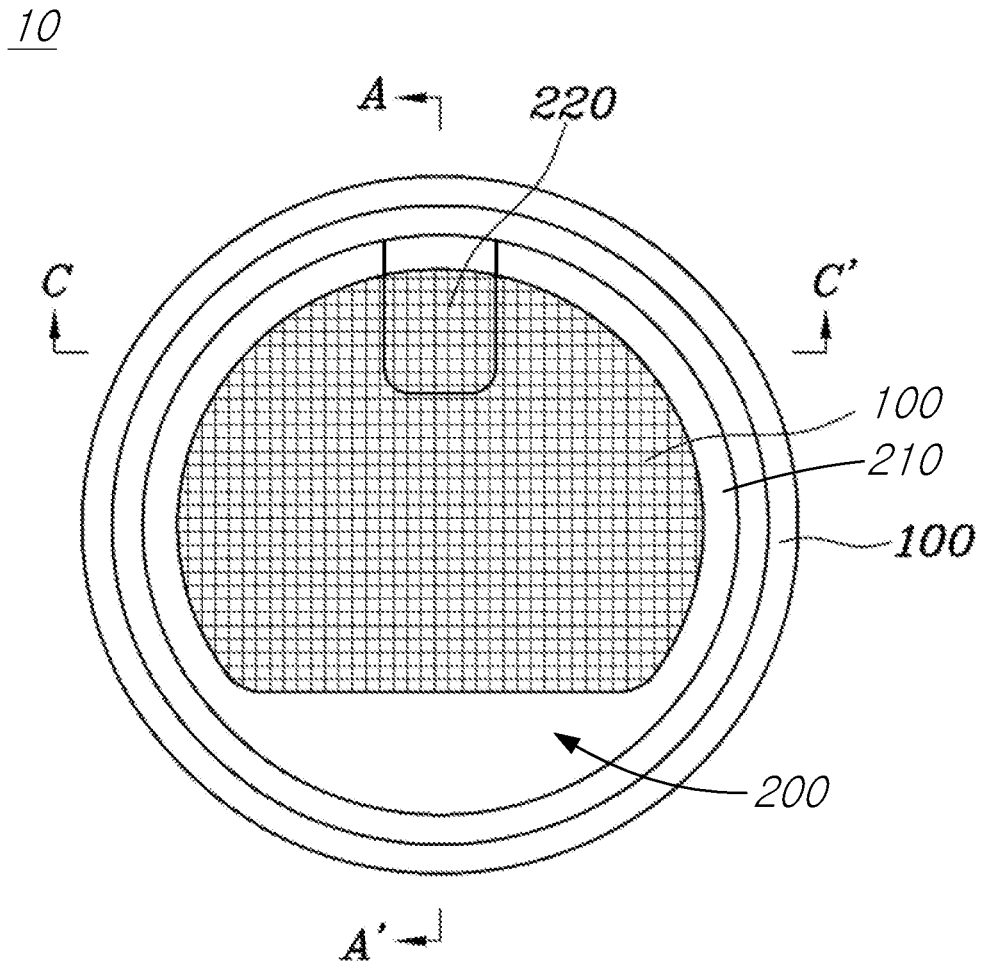
FIGS. 1A and 1B shows a sealing cap of a powder container according to an embodiment of the present invention, as viewed from an upper surface of the sealing cap.

The present invention may have many examples and various modifications may be made, and specific examples will be illustrated in drawings and explained in detail. Advantages and features of the present invention and a method of achieving the same will be clearly understood from embodiments described below in detail with reference to the accompanying drawings. However, the present invention is not limited to the following embodiments and may be implemented in various different forms. In the following embodiments, terms such as "first" and "second" are used for describing various constituent elements, but the constituent elements are not limited by the terms. In addition, singular forms used include a plurality of forms unless phrases explicitly represent an opposite meaning. A meaning of "comprises" and/or "comprising" used in a specification does not exclude the presence or addition of at least one of other constituent elements. In the drawings, the thicknesses, areas, etc., of constituent elements may be exaggerated or reduced for clarity and convenience of illustration. The embodiments of the invention are not limited to the illustrated thicknesses, areas, etc.

Hereinafter, an exemplary embodiment of the present disclosure will be described in detail with reference to the accompanying drawings, in which like reference numerals refer to like or similar constituent elements and a duplicated description Hereinafter, a sealing cap of a powder container according to preferred embodiments of the present invention will be described with reference to the accompanying drawings.

Figure 1B:
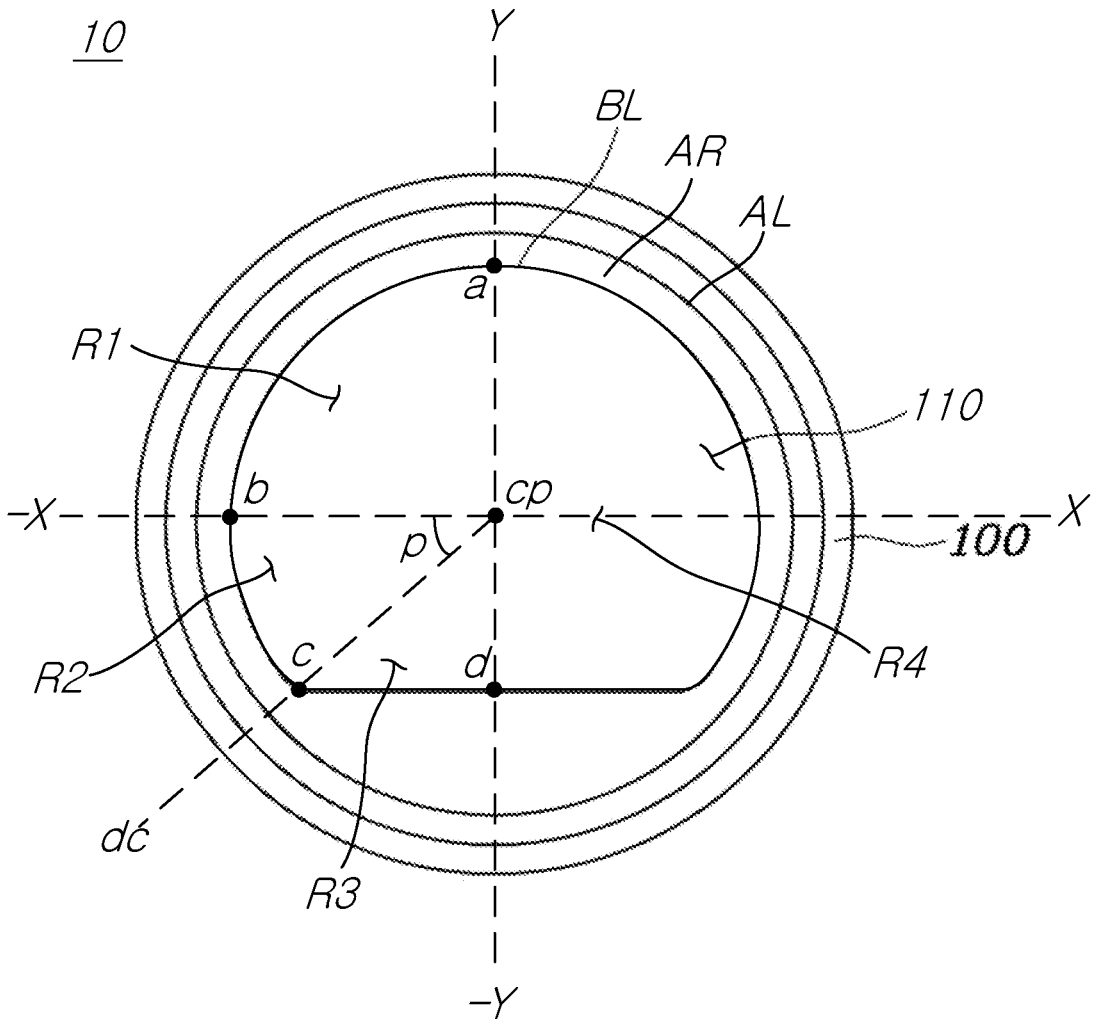
Figure 2:
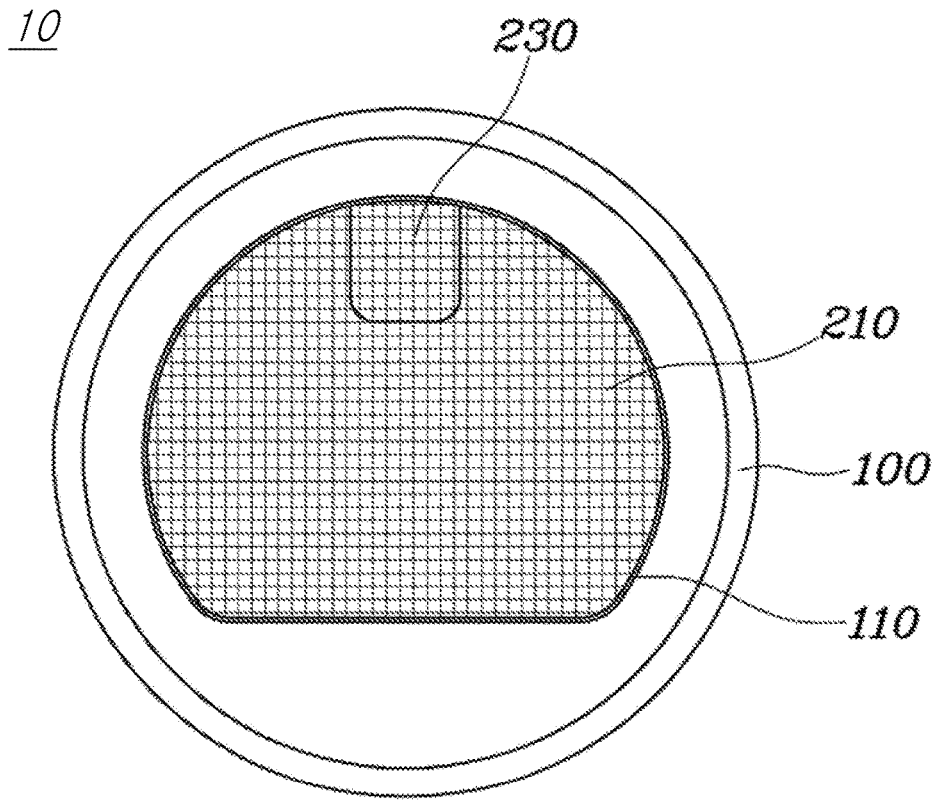
FIG. 2 shows a sealing cap of a powder container according to an embodiment of the present invention, as viewed from a lower surface of the sealing cap.
Figure 3:
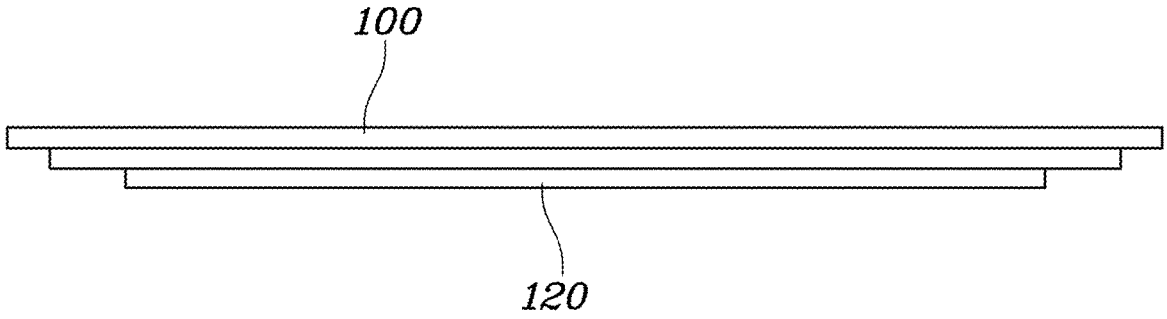
FIG. 3 shows a sealing cap of a powder container according to an embodiment of the present invention, as viewed from a side surface of the sealing cap.
Figure 4:
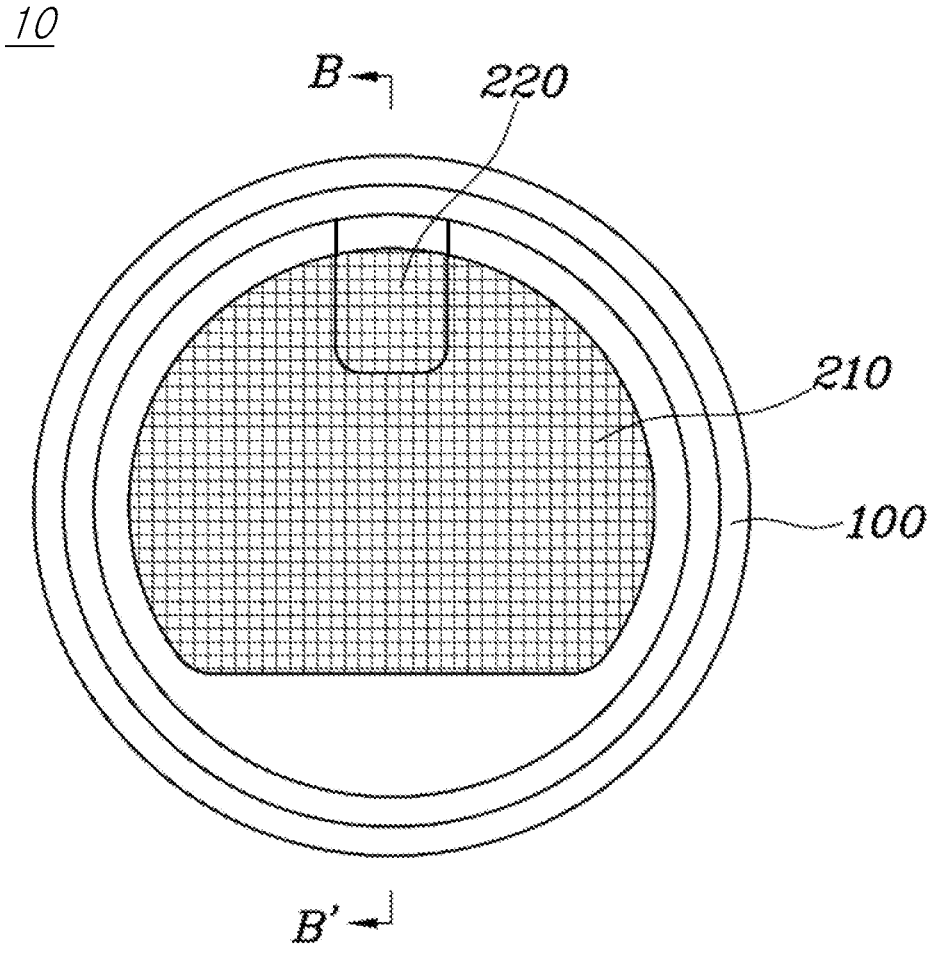
FIG. 4 shows a sealing cap of a powder container according to another embodiment of the present invention, as viewed from an upper surface of the sealing cap.
Figure 5:
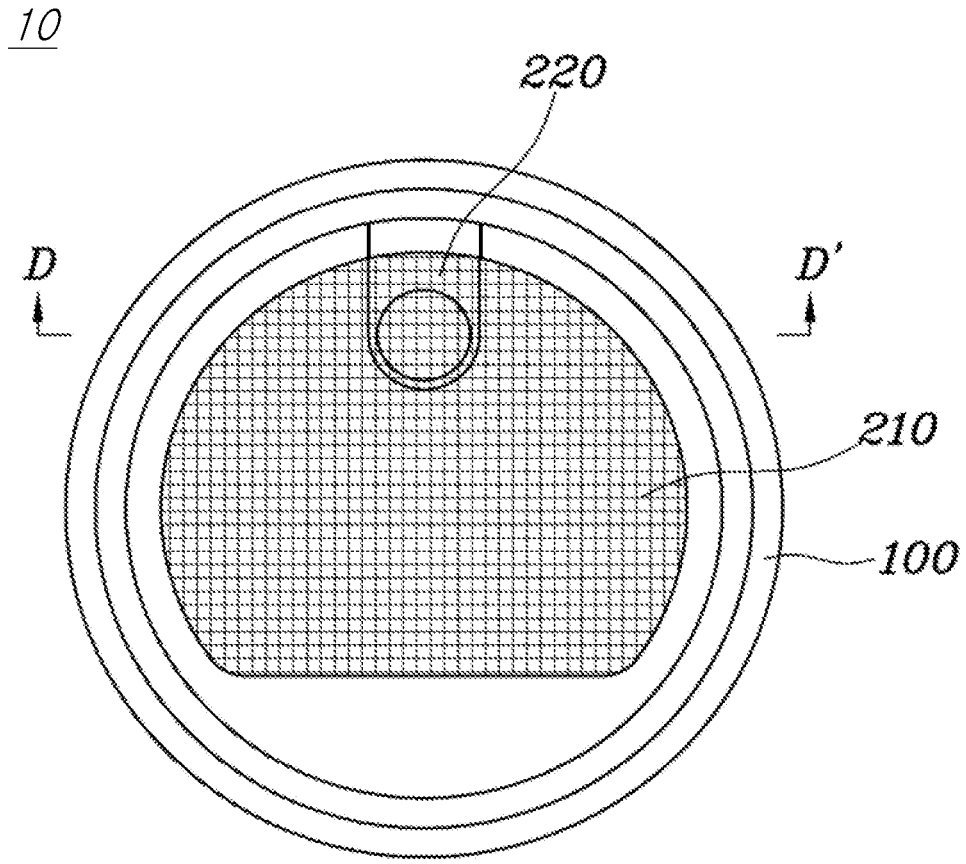
FIG. 5 shows a sealing cap of a powder container according to yet another embodiment of the present invention, as viewed from an upper surface of the sealing cap.
Figure 6:
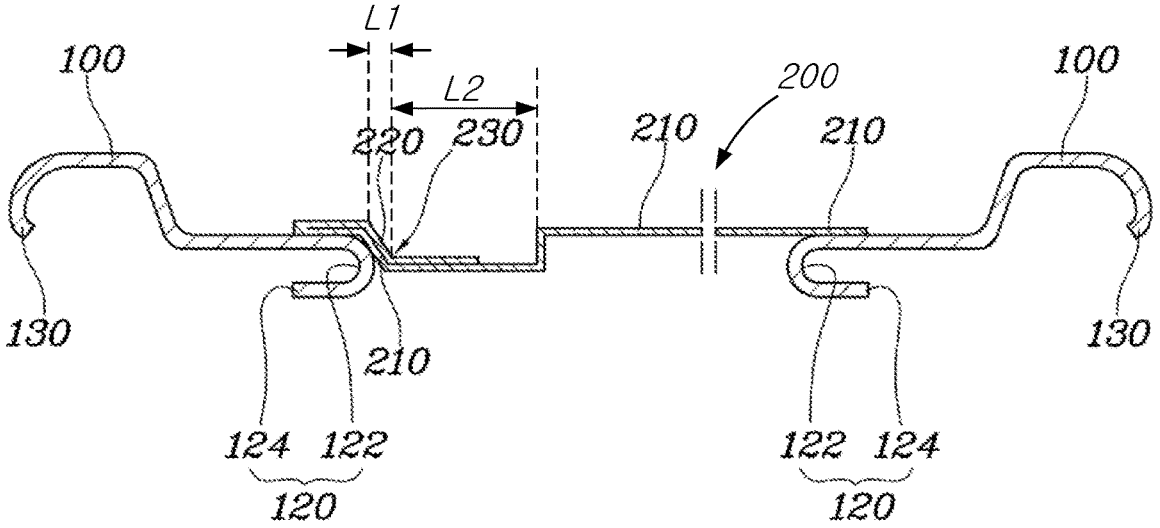
FIG. 6 is a cross-sectional view of FIG. 1 taken along line A-A'.
Figure 7:
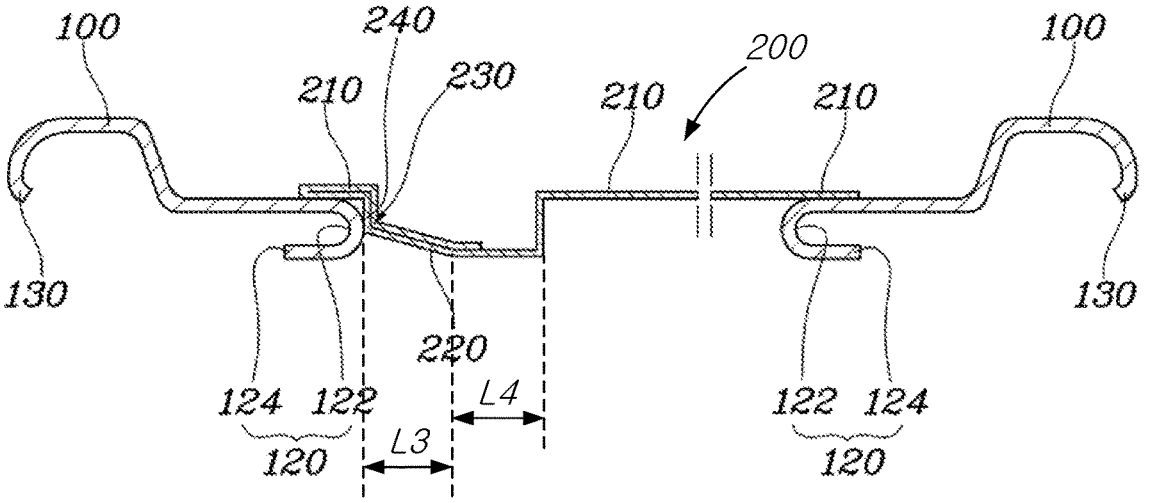
FIG. 7 is a cross-sectional view of FIG. 4 taken along line B-B'.
Figure 8:
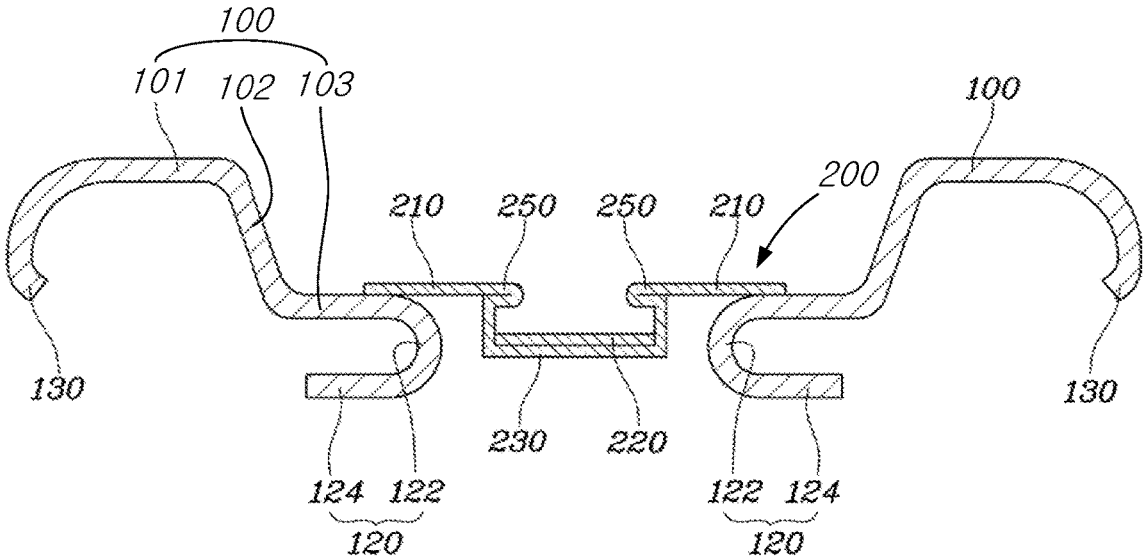
FIG. 8 is a cross-sectional view of FIG. 1 taken along line C-C'.
Figure 9:
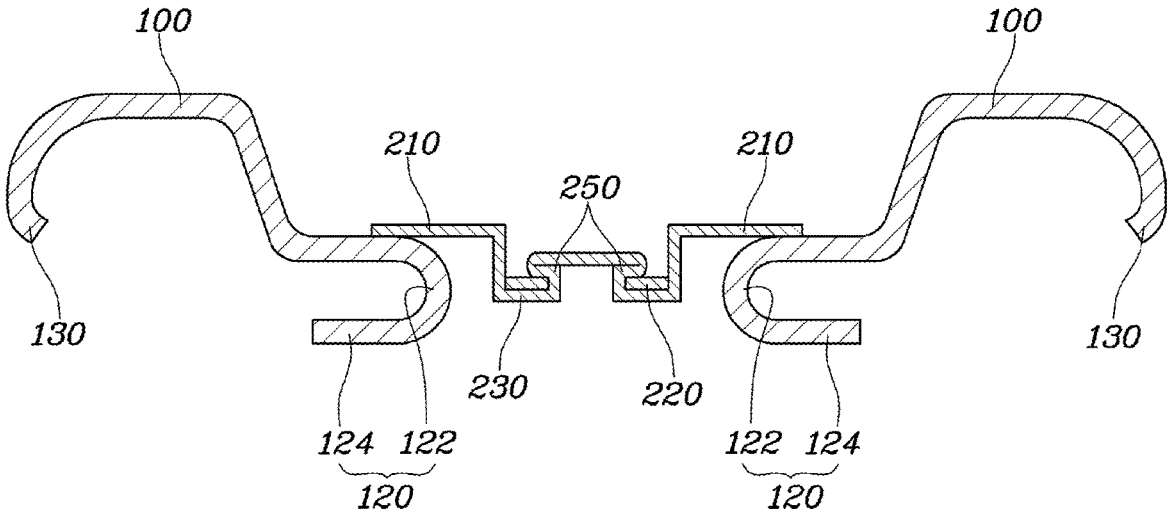
FIG. 9 is a cross-sectional view of FIG. 5 taken along line D-D'.
Figure 10:
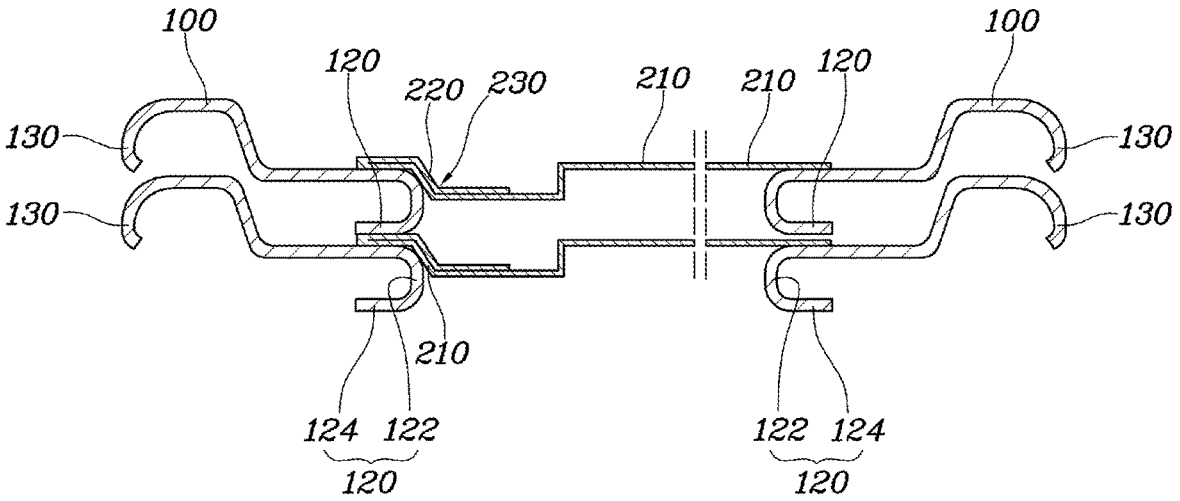
FIG. 10 is a diagram showing an example in which sealing caps of a powder container according to an embodiment are deposited.
Figure 11:
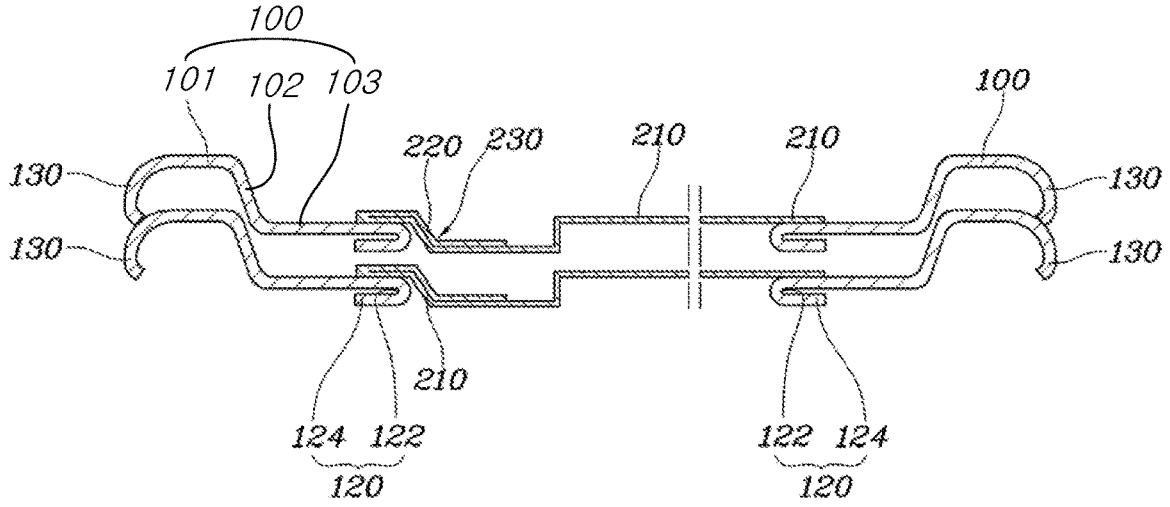
FIG. 11 is a diagram showing an example in which sealing caps of a powder container according to another embodiment are deposited.

FIGS. 1A and 1B shows a sealing cap of a powder container according to an embodiment of the present invention, as viewed from an upper surface of the sealing cap. FIG. 1A shows a sealing cap with a sealing part attached thereto, and FIG. 1B shows a sealing cap with the sealing part separated therefrom. FIG. 2 shows a sealing cap of a powder container according to an embodiment of the present invention, as viewed from a lower surface of the sealing cap. FIG. 3 shows a sealing cap of a powder container according to an embodiment of the present invention, as viewed from a side surface of the sealing cap. FIG. 4 shows a sealing cap of a powder container according to another embodiment of the present invention, as viewed from an upper surface of the sealing cap. FIG. 5 shows a sealing cap of a powder container according to yet another embodiment of the present invention, as viewed from an upper surface of the sealing cap. FIG. 6 is a cross-sectional view of FIG. 1 taken along line A-A'. FIG. 7 is a cross-sectional view of FIG. 4 taken along line B-B'. FIG. 8 is a cross-sectional view of FIG. 1 taken along line C-C'. FIG. 9 is a cross-sectional view of FIG. 5 taken along line D-D'. FIG. 10 is a diagram showing an example in which sealing caps of a powder container according to an embodiment are deposited. FIG. 11 is a diagram showing an example in which sealing caps of a powder container according to another embodiment are deposited.

Referring to FIG. 1A to 9, a sealing cap 10 of a powder container according to an embodiment includes a cover part 100 coupled to the powder container (not shown), for example, an upper side of the powder container, and having an opening 110 formed therein. In addition, the sealing cap 10 includes a sealing part 200 having a sealing body 210, which is attached to an upper surface of the cover part 100 and covers the opening 110 to seal the opening 110, and a pulling part 220, which extends from one point on an outer edge of the sealing body 210.

More specifically, referring to FIG. 1B, the cover part 100 may have a circular shape, when viewed from the upper surface thereof. However, aspects of the present invention are not limited thereto.

Hereinafter, the shape of the opening 110 will be described in more detail. However, aspects of the present invention are not limited to the following description.

The cover part 100 has the opening 110 formed in the central area thereof. The opening 110 shown in FIG. 1B may be formed by cutting the cover part 100 into a circular shape in a manner in which part of the circular shape is formed as a horizontal straight line. That is, an inner edge of the cover part 100 has a round-shaped inner edge portion and a straight-line-shaped inner edge portion. The round-shaped inner edge portion has a shape corresponding to a virtual circle that passes both ends of the straight line. In addition, the pulling part 220 is disposed on one side of the cover part 100, and the straight-line-shaped inner edge portion is disposed on the other side of the cover part 100.

More specifically, a virtual horizontal axis passing a virtual center point cp of the cover part 100 is defined as X axis, and a virtual vertical axis passing the virtual center point cp of the cover part 100 is defined as Y axis. In this case, the Y axis passes a center point of the straight line. In addition, the opening 110 may be defined as an area surrounded by a boundary line BL that is an inner edge of the cover part 100. It is defined such that an intercept where the boundary line BL crosses the positive side of the vertical Y axis is a point a, an intercept where the boundary line BL crosses the negative side of the vertical Y axis is a point d, and an intercept where the boundary line BL crosses the negative side of the horizontal X axis. In this case, the point d is the center point of the straight line. In the area of the opening 110, a distance from the center point cp of the cover part 100 to the point a may be equal to a distance from the virtual center point cp to the point b. In addition, a virtual line from the center point cp of the cover part 100 to the point a and a virtual line from the center point cp to the point b may form a right angle. In addition, it is possible to define a virtual fan-shaped area whose radius is the distance from the center point cp of the cover part 100 to the point a or the distance from the center point cp of the cover part 100 to the point b, and whose arc is a line from the point a to the point b on the boundary line BL. In addition, this fan-shaped virtual area may be a first area R1 of the opening 110.

In addition, if a virtual slope line dc passing the center point cp at a negative angle from the negative side of the X axis is defined, an intercept where the slope line dc passes the boundary line BL is formed as a virtual point c which is positioned on the left lower side of the drawing. In addition, it is possible to define a virtual fan-shaped area whose radius is the distance from the center point cp of the cover part 100 to the point b or the distance from the center point cp of the cover part 100 to the point c, and whose arc is a line from the point b to the point c on the boundary line BL. In addition, this virtual fan-shaped area may be a second area R2 of the opening 110. In addition, it is possible to define a virtual triangle whose hypotenuse is from the center point to the point c, whose height is from the center point cp to the point d, and whose base is from the point c to the point d. In addition, the virtual triangular-shaped area may be a third area R3 of the opening 110. In addition, a portion of the boundary line BL around the point C may be a round-shaped line. In addition, it is possible to define a fourth area R4 that is symmetric to the first to third areas R1, R2, and R3 with reference to the Y axis. In addition, the opening 110 consists of the first to fourth areas R1, R2, R3, and R4.

On the upper surface of the cover part 100, a virtual attachment line AL marked with a solid lie is illustrated. The attachment line AL may be a circular line surroundings the boundary line BL. An attachment area AR is defined between the boundary line BL and the attachment line AL. As shown in FIG. 1A, when the sealing part 200 is attached to the cover part 100, the periphery of a lower surface of the sealing part 200 may be attached to the attachment area AR and cover the opening 110.

Referring to FIG. 1A, the sealing part 200 may have a circular shape, but aspects of the present invention are not limited thereto. The entire area of the sealing part 200 may be substantially identical to an area surrounded by the attachment line Al in FIG. 1B.

Referring to FIG. 2 which shows a bottom surface of the sealing cap 10, a mounting groove 230 recessed toward the inner space of the powder container at a portion where the sealing body 210 overlaps the pulling part 220 may be formed in the sealing part 200.

Specifically, detailed configuration of the sealing part 200 will be described. As shown in FIGS. 1A to 3, the sealing body 210 is attached to the upper surface of the cover part 100 and covers the opening 110 to seal the opening 110. In some embodiments, the sealing body 210 may be formed of an aluminum sheet, but aspects of the present invention are not limited thereto. The sealing body 210 may be attached to the upper surface of the cover part 100 along the edge of the opening 110 using adhesive, but a material other than the adhesive may be utilized or a thermal fusion technique may be used to attach the sealing body 210 to the upper surface of the cover part 100. That is, a lower surface of the edge portion of the sealing body 210 may be attached to the periphery of the opening 110 of the cover part 100. More specifically, the periphery of the lower surface of the sealing body 210 may be attached to the attachment region AR of the cover part 100. Therefore, the entire area of the sealing body 210 is larger than the entire area of the opening 110 by the attachment region AR. In addition, as shown in FIG. 10, if a plurality of sealing caps is deposited, an upper surface of an edge of a lower sealing body 210 may contact a support portion 124 of a different sealing cap that is deposited right on the corresponding sealing cap.

In addition, the pulling part 220 may extend from one point on the outer edge of the sealing body 210 toward the central area of the sealing body 210. In addition, as the pulling part 220 is folded by being bent toward the center area of the upper surface of the sealing body 210, the pulling part 220 may overlap the sealing body 210. In other words, the pulling part 220 and the sealing body 210 may be integrally formed into one body. In addition, in some embodiments, the pulling part 220 may be formed of an aluminum sheet, as does the sealing body 210, but aspects of the present invention are not limited thereto.

In addition, edges of both ends of the pulling part 220 may be in a round shape, but aspects of the present invention are not limited thereto.

In addition, further referring to FIG. 6, as the pulling part 220 is folded by being bent at an extension point on the outer edge of the sealing body 210 toward the upper surface so as to overlap the sealing body 210, the sealing body 210 has an area overlapping the pulling part 220. That is, as the overlapping area is recessed in a downward direction, that is, recessed toward an inner space of the powder container, the mounting groove 230 may be formed. In some embodiments, the mounting groove 230 may be formed in an area where the sealing body 210, the pulling part 220, and the opening 110 overlap one another. Furthermore, the mounting groove 230 may be comprised of an open upper surface, a side surface, and a bottom surface, and the shape of the bottom surface of the mounting groove 230 may correspond to the shape of the pulling part 220. As such, as the shape of the bottom surface of the mounting groove 230 is formed to correspond to the shape of the pulling part 220, the pulling part 220 is allowed to be mounted on the bottom surface of the mounting groove more stably in an overlapping manner.

Meanwhile, as showing in FIG. 6, the mounting groove 230 may be formed to be recessed from one end toward the other end of the edge of the opening 110 in a direction toward the inner space of the powder container.

In addition, the mounting groove 230 may be formed such that a recess depth thereof becomes greater from one end toward the other end of the edge of the opening 110. That is, a downward slope side surface L1 may be formed in which a recess depth of the mounting groove 230 becomes greater from one side of the edge of the opening 110 toward the central area of the opening 110, and then a parallel bottom surface L2 may be formed in which the recess depth of the mounting groove 230 is maintained constant toward the central area of the opening 110. In the present invention, a portion of the area of the sealing body 210 attached to the upper surface of the cover part 100, the portion which overlaps the pulling part 220, is recessed from one end of the edge of the opening 110 toward the inner space of the powder container. Accordingly, a portion of the sealing body 210 extends to form the mounting groove 230. In addition, when the mounting groove 230 is formed, an area on the one end of the edge of the opening 110 in the entire area of the mounting groove 230 may have the most shallow depth. Accordingly, it is possible to prevent the sealing body 210 from being fractured at one end of the edge of the opening 110.

As shown in FIG. 7, in a sealing cap of a powder container according to another embodiment of the present invention, the sealing body 200 may include a step 240 that is formed as a sealing body 210 is bent downward at one end of the edge of an opening 110. In this case, a mounting groove 230 may be formed to be recessed from a lower end portion of the step 240 toward the other end of the edge of the opening 110 in a direction toward an inner space of the powder container, and the recess depth of the mounting groove 230 may become greater in a direction toward the other end of the edge of the opening 110. More specifically, a downward slope bottom surface L3 may be formed in which the recess depth of the mounting groove 230 becomes greater from a bent portion toward a central area of the opening 110, and then a parallel bottom surface L4 may be formed in which the recess depth of the mounting groove 230 is maintained constant toward the central area of the opening 110. In this case, as shown in FIG. 7, a pulling part 220 is bent along the step 240 in a state in which the pulling part 220 is in close contact with the step 240 at a portion where the step 240 is formed, and then the pulling part 230 is mount on the mounting groove 230 in a state in which the pulling part 220 is in close contact with the mounting groove 230 in a downward inclined direction from the lower end portion of the step 240. As such, the step is formed at one end of the edge of the opening 110. That is, while part of the side surface of the mounting groove 230 in FIG. 6 is the downward slope side surface L1, part of the side surface of the mounting groove 230 in FIG. 7 is a vertical side surface to form a step. Also, in the course of mounting the pulling part 220 on the mounting groove 230, the pulling part 220 is bent along the step 240 while in close contact with the step 240 at a portion where the step 240 is formed, and then pulling part 220 is mounted on the mounting groove 230. Accordingly, it is possible to prevent that in the course of filling powder in the powder container or assembling and conveying the powder container, the pulling part 220 comes out of the mounting groove 230 to be caught or torn apart by an external device.

Meanwhile, further referring to FIG. 8, the sealing part 200 may further include a deviation preventing part 250 that prevents the pulling part 220 mounted in the mounting groove 230 from being deviated from the mounting groove 230. Specifically, the deviation preventing part 250 may be in the shape of an undercut projection that is projected from a side surface of the mounting groove 230 toward the inside of the mounting groove 230. More specifically, the deviation preventing part 250 may be a projection projected from a side surface of the mounting groove 230 along a longitudinal direction of the pulling part 220. In addition, the deviation preventing part 250 may be projection projected from both side surfaces of the mounting groove 230. In addition, the deviation preventing part 250 are formed by being projected from the both side surfaces of the mounting groove 230 in a direction to become closer to each other.

In the present invention, as the pulling part 220 is mounted on the mounting groove 230 in a manner of overlapping the bottom surface of the mounting groove 230, the pulling part 220 is disposed at a position lower than the upper surface of the sealing body 210. That is, the pulling part 220 is disposed at a position lower than other areas except the mounting groove 230 in the upper surface of the sealing body 210. In addition, as the deviation preventing part 250 in the shape of an undercut projection projected toward the inside of the mounting groove 230 is formed on a side surface of the mounting groove 230, it is possible to more safely prevent the pulling part 220 from being deviated from the mounting groove 230. Accordingly, it is possible to prevent that, in the course of filling powder in the powder container or assembling or conveying the powder container, the pulling part 220 comes out to be caught or torn off by an external device.

In addition, if the pulling part 220 is in the shape of a ring having a hold hole formed therein, as shown in FIG. 5, the deviation preventing part 250 in FIG. 9 may be in the shape of an undercut projection which is projected toward a side surface of the mounting groove 230, and which is formed at a portion around the hold hole. Specifically, a portion of the sealing body 210 corresponding to the central area of the mounting groove 230 may be projected upward, and, at the same time, a projected end may be projected toward both side surfaces of the mounting groove 230. More specifically, when the pulling part 220 is mounted on the mounting groove 230, a portion of the bottom area of the mounting groove 230 corresponding to the hold hole may be projected upward and an end of the projected portion may be projected toward the both side surfaces of the mounting groove 230. Accordingly, as shown in FIG. 9, the deviation preventing part 250 may generally have a T shape. When the pulling part 220 is mounted on the mounting groove 230, the deviation preventing part 250 penetrates the hold hole of the pulling part 220, and hence, a portion of the deviation preventing part 250 being projected upward and a portion of the deviation preventing part 250 being projected toward a side surface of the mounting groove 230 may surround the periphery of the hold hole.

In other words, as the pulling part 220 having the hold hole formed therein is mounted on the mounting groove 230 in a manner of overlapping the bottom surface of the mounting groove 20, the pulling part 220 is disposed at a position lower than the upper surface of the sealing body 210. In addition, as the deviation preventing part 250 in in the shape of an undercut projection being projected toward a side surface of the mounting groove 230 is formed at a portion around the hold hole, it is possible to more safely prevent the pulling part 220 from being deviated from the mounting groove 230. Accordingly, it is possible to prevent that the pulling part 220 comes out of the mounting groove 230 to be caught or torn apart by an external device in the course of filling powder in the powder container or assembling and conveying the powder container.

In addition, in the present invention, embo-shape forming processing may be performed on the sealing part 200, as shown in FIGS. 1A, 2, 4, and 5. In some embodiments, the embo-shape forming process may be performed on a portion of the sealing part 200 corresponding to the opening 110. Accordingly, the pulling part 220 may be physically coupled to the mounting groove 230 through embo-coupling. As such, as the pulling part 220 overlaps the bottom surface of the mounting groove 230, the pulling part 220 is allowed to be disposed at a position lower than the upper surface of the sealing body 210 and the pulling part 220 is physically coupled to the mounting groove 230 through embo-coupling. Accordingly, it is possible to prevent that the pulling part 220 comes out of the mounting groove 230 to be caught or torn apart by an external device in the course of filling powder in the powder container or assembling and conveying the powder container.

Meanwhile, as shown in FIGS. 6 to 11, the cover part 100 may further include a first finishing part 120 that is formed by being bent downward from one portion on the edge of the opening 110 along the edge of the opening 110. In this case, a height of the mounting groove 230 may be equal to or higher than a height of the first finishing part 120. Specifically, the first finishing part 120 may be comprised of a downward portion 122 bent downward from the edge of the opening 110, and a support portion 124 bent outward of the opening 110 from a lower end of the downward portion 122. More specifically, the first finishing part 120 is comprised of: the downward portion 122 extending from one portion on the edge of the opening 110 and bent downward; and the support portion 124 bent at an end of the downward portion 122 and extending parallelly to the upper surface of the cover part 100 from the end of the downward portion 122 toward a peripheral portion of the cover part 100. In addition, a bent portion between the downward portion 122 and the support portion 124 may have a round shape. In this case, when a plurality of sealing caps is deposited, a support portion 124 of any one sealing cap may be brought into contact with a sealing body 210 of another sealing cap positioned under the corresponding sealing cap and thereby supported by the sealing body 210 of the another sealing cap.

In addition, as shown in FIGS. 6, 8, 9, and 10, a height of the mounting groove 230 may be formed to be equal to or higher than a height of the first finishing part 120. That is, the bottom surface of the mounting grove 230 may be positioned at a height higher than a height of the bottom surface of the support portion 124 of the first finishing part 120. Accordingly, as illustrated in FIG. 10, when a plurality of sealing caps is deposited, a support portion 124 of an upper sealing cap is brought into contact with a sealing body 210 of a lower sealing cap under the upper sealing cap and thereby supported by the sealing body 210 of the lower sealing cap, and therefore, the bottom surface of the mounting groove 230 of the upper meaning cap may be spaced apart from the upper surface of the sealing body 210 of the lower sealing cap. Accordingly, it is possible to prevent the sealing part 200 from being damaged due to contact and friction with the sealing body 210, which is formed of a material relatively soft compared to the cover part 100, in the course of depositing a plurality of sealing caps. In addition, it is possible to prevent the bottom surface of the cover part 100 from being brought into contact with a conveyer belt when a sealing cap moves on the conveyer belt or the like in a single process of manufacturing a sealing cap, thereby preventing damage to the cover part 100.

In addition, the cover part 100 may further include a second finishing part 130 that is formed by being bent downward from one point on the edge of the cover part 100 along the edge of the cover part 100. More specifically, the second finishing part 130 may be formed in the cover part 10, the second finishing part 130 is in the shape that is bent in a downward direction from the periphery of the cover part 100, bent toward the inside of the cover part 100, and then extends. In this case, the second finishing part 130 may generally have a round shape.

In addition, referring to FIG. 8, the cover part 100 may include a first area 101, a second area 102, and a third area 103. Each of the first area 101 and the third area 103 may be a horizontal area. In addition, the second area 102 may be a slope area that connects the first area 101 and the third area 103. The second area 102 may be a downward slope area extending from one side of the first area 101 to be connected to one side of the third area 103. Therefore, the first area 101 and the third area 103 form a step therebetween. In addition, the first finishing part 120 is formed as extending from the other end of the third area 103, and the second finishing part 130 is formed as extending from the other side of the first area 101. In addition, a difference in height between the first area 101 and the second area 102 may vary depending on an extension length and a slope gradient of the second area 102.

Meanwhile, a height of the second finishing part 130 may be equal to or greater than a height of the mounting groove 230. That is, an end of the second finishing part 130 may be at a position higher than a height of the bottom surface of the mounting groove 230. As such, the height of the second finishing part 130 is equal or greater than the height of the mounting groove 230, and thus, when a plurality of sealing caps according to another embodiment of the present invention is deposited as shown in FIG. 11, a bottom surface of a mounting groove 230 of an upper sealing cap may be spaced apart from an upper surface of a sealing body 210 of a lower sealing cap positioned under the upper sealing cap, and accordingly, it is possible to prevent a problem that can be caused due to heights of mounting grooves when the plurality of sealing caps is deposited.

In addition, the plurality of sealing caps is deposited in a manner in which an end of a second finishing part 130 of one sealing cap from among the plurality of sealing caps is brought into contact with and mounted on an upper end area of a second finishing part 130 of another sealing cap positioned under the corresponding sealing cap. In this case, in order to prevent a first finishing part 120 of the corresponding sealing cap from being brought into contact with a sealing body 210 of the another sealing cap positioned under the corresponding sealing cap, an extension length of the second finishing part 130 from the first area 101 or an extension length of the first finishing part 120 from the third area 103 may be decided.

Figure 12:
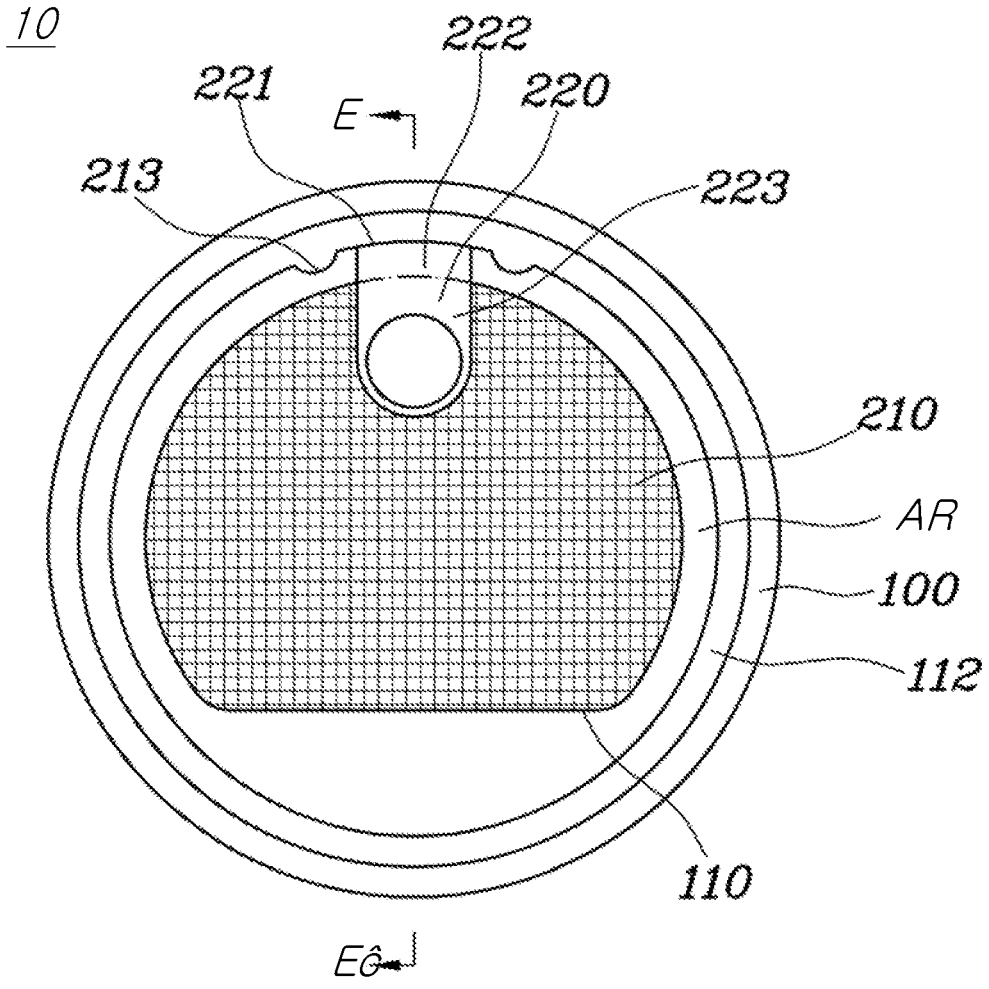
FIG. 12 is a top view of a sealing cap of a powder container according to yet another embodiment of the present invention.
Figure 13:
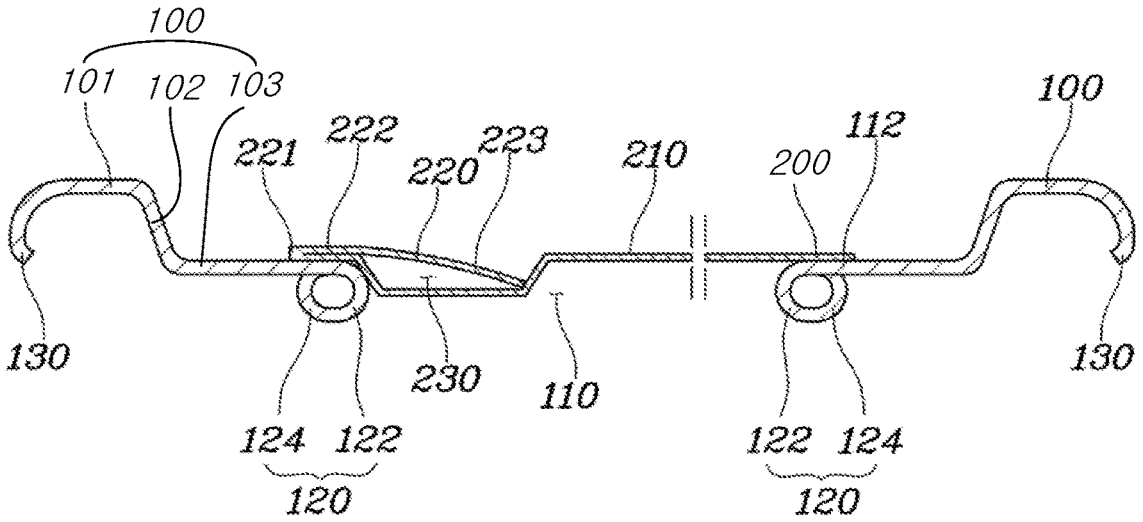
FIG. 13 is a cross-sectional view of the sealing cap in FIG. 12 taken along line E-E'.
Figure 14:
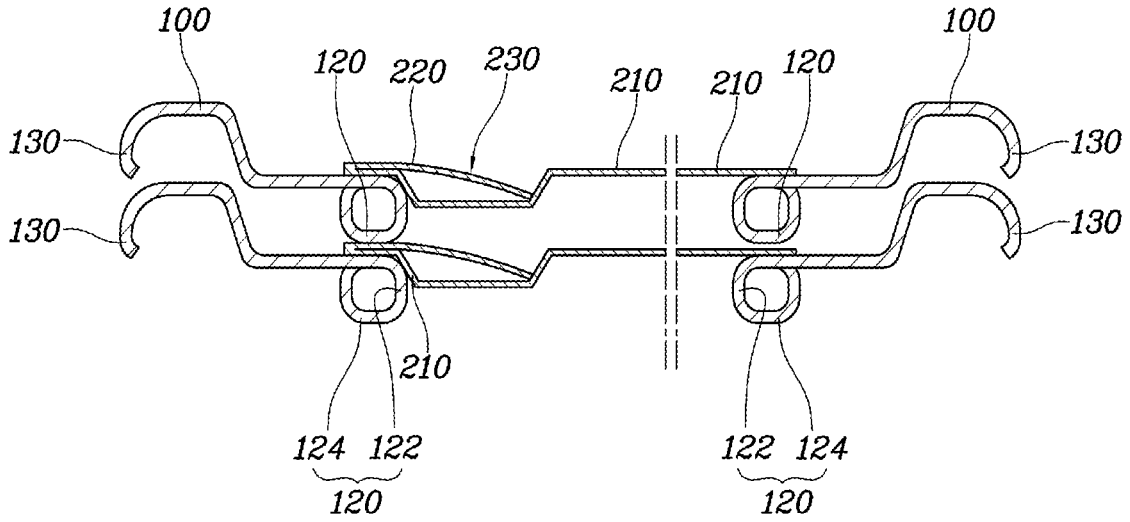
FIGS. 14 and 15 shows an example in which a sealing cap of a powder container according yet another embodiment of the present invention is deposited with one another.
Figure 15:
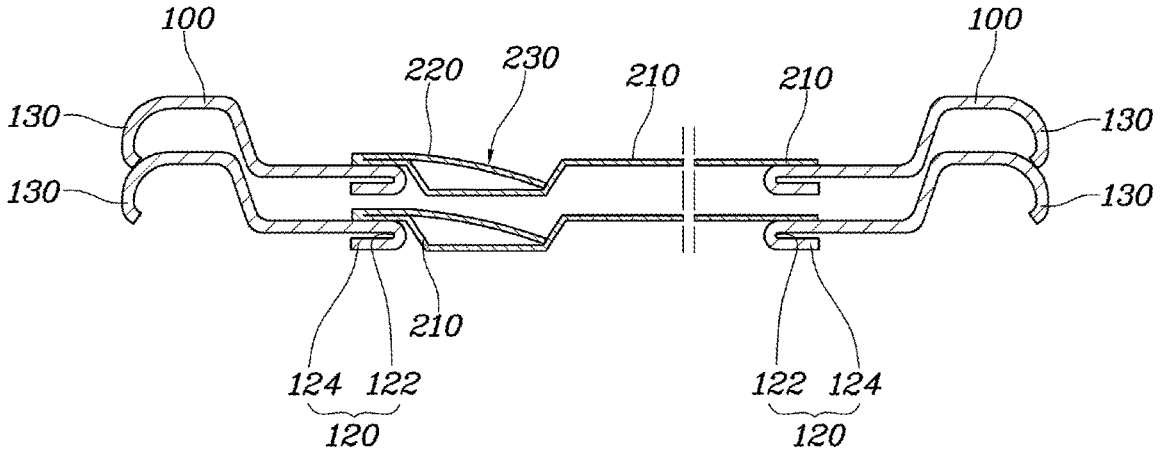

FIG. 12 is a top view of a sealing cap of a powder container according to yet another embodiment of the present invention, and FIG. 13 is a cross-sectional view of the sealing cap in FIG. 12 taken along line E-E'. In addition, FIGS. 14 and 15 shows an example in which a sealing cap of a powder container according yet another embodiment of the present invention is deposited with one another.

In the following description about yet another embodiment of the present invention, the embodiment will be described mainly about elements different from the above-described embodiments.

Referring to FIGS. 12 and 13, a lower surface of an edge of a sealing body 210 may be attached to an upper surface of a flange portion 112 of a cover part 100, wherein the flange portion 112 corresponds to an edge of an opening 110 of the cover part 100. In some embodiments, the upper surface of the flange portion 112 may be the attachment area AR described above with reference to FIG. 1B. In addition, as shown in FIG. 14, when a plurality of sealing caps is deposited, an upper surface of a periphery of a sealing body 210 of any one sealing cap may be brought into contact with a lower surface of a support portion 124 of another sealing cap positioned over the corresponding sealing cap.

A pulling part 220 may be formed to extend at one point on an outer edge of the sealing body 210, and the pulling part 220 may be folded by being bent toward an upper surface of the sealing body 210, that is, folded reversely by being bent toward the central area of the sealing body 210, thereby overlapping the sealing body 210. In other words, the pulling part 220 may be integrally formed with the sealing part 210 into one body, and, in some embodiments, the pulling part 220 may be made of the same material as that of the sealing body 210, such as an aluminum sheet or the like, and formed to extend.

When folded, the pulling part 220 is inserted into the inside of a mounting groove 230 such that the pulling part 220 has a height lower than a height of a plane formed by the upper surface of the sealing part 200. That is, the pulling part 220 may be positioned at a height lower than a height of other areas except the mounting groove 230 over the upper surface of the sealing part 200. In another aspect, other areas except an overlapping area of the attachment area AR in the upper surface of the pulling part 220 may be positioned at a height lower than a height of a plane formed by the upper surface of the sealing part 200. In another aspect, other areas except an area overlapping the cover part 100 over the upper surface of the pulling part 220, that is, an area overlapping the opening 110, may be positioned at a height lower than a height of a plane formed by the upper surface of the sealing part 200.

The pulling part 220 may extend from an area of a peripheral end of the sealing body 210, be folded reversely to overlap part of the upper surface of the sealing body 210, and be then inserted into the mounting groove 230 in the folded state.

In this case, if the pulling part 220 is bent sharply from a bent portion and brought into close contact with the bottom surface of the mounting groove 230, the pulling part 220 may be forced to be unfolded again due to spring back after the bending of the pulling part 220 itself. As a result, the pulling part 220 may come out of the upper surface of the sealing part 200. In addition, it is economically efficient to place the pulling part 220 in the mounting groove 230 through bending, without an additional adhesive element such as glue, a rivet, and the like, and thus, it is preferable to rather excessively bring the pulling pa pulling part rt 220 into close contact with the mounting groove 230 in order to be mounted in the mounting part 230, without bending the pulling part 220 multiple times. Therefore, it is preferable that, while the pulling part 220 is spaced apart from the bottom surface of the mounting groove 230, the pulling part 220 is bent to extend downward toward the bottom surface of the mounting groove 230 and that only an end portion of the is brought into contact with the bottom surface of the mounting groove 230 or an inner surface of the mounting groove 230. In another aspect, although FIGS. 13, 14, and 15 shows an example in which an end portion of the pulling part 220 is in contact with a boundary area between the bottom surface and an inner surface of the mounting groove 230, but aspects of the present invention are not limited thereto. That is, while the pulling part 220 is spaced apart from the bottom surface of the mounting groove 230, the pulling part 220 may be bent to extend in a downward inclined direction toward the bottom surface of the mounting groove 230, and an end portion of the pulling part 220 may become close to the bottom surface or an inner surface of the mounting groove 230, without in contact with the bottom surface or the inner surface of the mounting groove 230.

More specifically, the bottom surface of the mounting groove 230 may be an area which is parallel with the sealing body 210, and which is positioned lower than the upper surface of the sealing body 210. In addition, the pulling part 220 is also formed in a plate shape, which is bent and extends downward obliquely. In addition, the pulling part 220 starts to extend in a state in which the pulling part 220 is spaced apart from the bottom surface of the mounting groove 230.

The pulling part 220 extends in a plate shape, and an end portion thereof is brought into close contact with the bottom surface of the mounting groove 230. In doing so, the pulling part 220 is allowed to be placed in the inside of the mounting groove 230 and the number of times of bending the pulling part 220 is minimized, which eases the spring back phenomenon, and furthermore the pulling part 220 is able to stably remain in the inside of the mounting groove 230 without an additional process using glue, a rivet, or the like.

Meanwhile, the pulling part 220 is bent at an outer side edge of the sealing body 210. In addition, the pulling part 220 is pressed by the sealing body 210 at a point 222 where the pulling part 220 overlaps the flange portion 112, and a portion of the pulling part 220 extending after the point 222 is bent downward and then placed in the inside of the mounting groove 230. That is, the start portion of the pulling part 220 is tightly fixed to the sealing body 210, and the extending portion of the pulling part 220 is placed in the inside of the mounting groove 230. Accordingly, the bending portion 221 is also able to be maintained in a surely bent state without the spring back phenomenon.

In addition, a cut-off portion may be formed on both sides of the pulling part 220 on the outer side edge of the sealing body 210, the cut-off portion which is cut off partially in an inward direction. In the course in which a user pulls the pulling part 220 to remove the sealing part 200, the user pulls the pulling part 220 to deviate the pulling part 220 from the mounting groove 230 and then keeps pulling the pulling part 220 to eventually remove the sealing body 210. In order to make the sealing body 210 to be easily removed in this course, the cut-off portion 213 which is cut off partially in an inward direction may be formed on both sides of the pulling part 220.

By use of the cut-off portion 213, a pulling force applied by the user to the pulling part 220 may be effectively delivered and concentrated to both sides of the sealing body 210, and accordingly, it is possible to address a problem that only the pulling part 220 tears apart with a failure of removing the sealing body 210. In addition, it is possible to guide the sealing body 210 to start being tearing apart on both sides without an error.

Meanwhile, as the pulling part 220 is formed in a ring shape having a hold hole which extends after a point where the pulling part 220 overlap the flange portion 112, this makes a user to easily deviate the pulling part 220 from the mounting groove by using a nail or to effectively pull the pulling part 220 by inserting a finger in the hold hole.

Meanwhile, the cover part 100 may further include a first finishing part 120 that is formed by being bent downward from a portion on the edge of the opening 110 along the edge of the opening 110. In addition, a height of the mounting groove 230 may be equal to or greater than a height of the first finishing part 120. More specifically, the first finishing part 120 may be comprised of a downward portion 122 bent downward from the edge of the opening 110, and a support portion 124 bent outward of the opening 110 from a lower end of the downward portion. In addition, an end of the first finishing part 120 may be continued close to a portion of which the first finishing part 120 starts to extend. Accordingly, the first finishing part 120 may have a cross-section that is generally a round shape. In another aspect, the first finishing part 120 may be formed by projecting part of the lower surface of the cover part 100 downward. Specifically, the first finishing part 120 may be formed by projecting a portion of the lower surface of the cover part 100 corresponding to the edge of the opening 110 downward. In this case, the first finishing part 120 may correspond to the shape of the opening 110 and may be formed as a projected edge surrounding the opening 110.

In addition, the bottom surface of the mounting groove 230 may be positioned at a height higher than a height of the lower surface of the first finishing part 120. In another aspect, a height between the support portion 124 of the first finishing part 120 and a third area 103 may be higher than a recess depth of the mounting groove 230.

Accordingly, when a plurality of sealing caps is deposited, as shown in FIG. 14, the mounting groove 230 is brought into contact with a sealing body 210 of another sealing cap positioned under the corresponding sealing cap and thereby the recess depth of the mounting groove 230 may be supported by the sealing body 210 of another sealing cap.

As such, the height of the mounting groove 230 is formed to be equal to or higher than a height of the first finishing part 120, and thus, when a plurality of sealing caps is deposited as shown in FIG. 14, a support portion 124 of an upper sealing cap is brought into contact with a sealing body 210 of a lower sealing cap positioned under the upper sealing cap and thereby the support portion 124 of the upper sealing cap is supported by the sealing body 210 of the lower sealing cap. That is, the support portion 124 of the upper sealing cap is brought into contact with the periphery of the lower sealing cap and supported by the same. As a result, a bottom surface of a mounting groove 230 of the upper sealing cap may be spaced apart from an upper surface of the sealing body 210 of the lower sealing cap. Accordingly, it is possible to prevent the sealing part 200 from being damaged due to contact and friction with the sealing body 210, which is formed of a material relatively soft compared to the cover part 110, in the course of depositing a plurality of sealing caps.

In addition, referring to FIGS. 13 and 15, the cover part 100 may include a first area 101, a second area 102, and a third area 103. The first area 101 and the third area 103 may be horizontal areas. In addition, the second area 102 may be a slope area that connects the first area 101 and the third area 103. The second area 102 may be a downward slope area that extends from one side of the first area 101 to be connected to one side of the third area 103. Therefore, the first area 101 and the third area 103 form a step therebetween. In addition, the first finishing part 120 is formed to extend from the other side of the third area 103, and the second finishing part 130 is formed to extend from the other side of the first area 101. In addition, a difference in height between the first area 101 and the second area 102 may vary depending on an extension length and a slope gradient of the second area 102.

Meanwhile, a height of the second finishing part 130 may be equal to or greater than a height of the mounting groove 230. That is, an end of the second finishing part 130 may be placed at a position higher than the bottom surface of the mounting groove 230. As such the height of the second finishing part 130 is formed to be equal to or greater than the height of the mounting groove 230, and thus, when a plurality of sealing caps according to another embodiment of the present invention is deposited as shown in FIG. 15, a bottom surface of a mounting groove 230 of an upper sealing cap may be spaced apart from an upper surface of a sealing body 210 of a lower sealing cap positioned under the upper sealing cap, and accordingly, it is possible to prevent a problem that can be caused due to heights of mounting grooves in the course of depositing the plurality of sealing caps.

In addition, the plurality of sealing caps is deposited in a manner in which an end of a second finishing part 130 of one sealing cap from among the plurality of sealing caps is brought into contact with and mounted on an upper end area of a second finishing part 130 of another sealing cap positioned under the corresponding sealing cap. In this case, in order to prevent a first finishing part 120 of the corresponding sealing cap from being brought into contact with a sealing body 210 of the another sealing cap positioned under the corresponding sealing cap, an extension length of the second finishing part 130 from the first area 101 or an extension length of the first finishing part 120 from the third area 103 may be decided.

As described above, according to the present invention, in a sealing part is coupled to an upper side of a powder container and attached to an upper surface of a cover part having an opening formed therein, a mounting groove recessed toward an inner space of the powder container is formed at a portion of the sealing body where the pulling part overlaps, and the pulling part is mounted in the corresponding mounting groove such that the pulling part is placed at a position lower than a position of an upper surface of the sealing body. Accordingly, it is possible to prevent that the pulling part is caught or torn apart by an external device in the course of filling powder in the powder container or assembling or conveying the powder container.

In addition, since the pulling part is stably mounted in the mounting groove, it is possible to prevent that the pulling part is caught or torn apart by an external device in the course of filling powder in the powder container or assembling or conveying the powder container or in the course of conveying the sealing cap or coupling the same to the powder container. In addition, when it comes to achieving the aforementioned structure, an additional welding process or a bonding process using glue or the like is not necessary, and there is an advantageous effect in that the structure can be achieved simply by use of a mold.

As described above, according to the present invention, in a sealing part is coupled to an upper side of a powder container and attached to an upper surface of a cover part having an opening formed therein, a mounting groove recessed toward an inner space of the powder container is formed at a portion of the sealing body where the pulling part overlaps, and the pulling part is mounted in the corresponding mounting groove such that the pulling part is placed at a position lower than a position of an upper surface of the sealing body. Accordingly, it is possible to prevent that the pulling part is caught or torn apart by an external device in the course of filling powder in the powder container or assembling or conveying the powder container. In addition, when it comes to achieve the structure according to the embodiment shown in FIG. 14, an additional welding process or a bonding process using glue or the like is not necessary, and there is an advantageous effect in that the structure can be achieved simply by use of a mold.

In addition, since the pulling part is mounted in the mounting groove and then the pulling part and the mounting groove are coupled to each other through embo-coupling, the pulling part is stably mounted in the mounting groove, and thus it is possible to prevent that the pulling part is caught by or torn apart by an external device in the course of filling powder in the powder container or assembling or conveying the powder container.

Furthermore, since a deviation preventing part in the shape of an undercut projection which is formed on an side surface of the mounting groove and projected toward the inside of the mounting groove, it is possible to stably fix the pulling part to the mounting groove and accordingly prevent that the pulling part is caught by or torn apart by an external device in the course of filling powder in the powder container or assembling or conveying the powder container.

According to the present invention, in a sealing part is coupled to an upper side of a powder container and attached to an upper surface of a cover part having an opening formed therein, a mounting groove recessed toward an inner space of the powder container is formed at a portion of the sealing body where the pulling part overlaps, and the pulling part is mounted in the corresponding mounting groove such that the pulling part is placed at a position lower than a position of an upper surface of the sealing body. Accordingly, it is possible to prevent that the pulling part is caught or torn apart by an external device in the course of filling powder in the powder container or assembling or conveying the powder container.

In addition, since the pulling part is stably mounted in the mounting groove, it is possible to prevent that the pulling part is caught or torn apart by an external device in the course of filling powder in the powder container or assembling or conveying the powder container or in the course of conveying the sealing cap or coupling the same to the powder container. In addition, when it comes to achieving the aforementioned structure, an additional welding process or a bonding process using glue or the like is not necessary, and there is an advantageous effect in that the structure can be achieved simply by use of a mold.

Furthermore, since a deviation preventing part in the shape of an undercut projection which is formed on an side surface of the mounting groove and projected toward the inside of the mounting groove, it is possible to stably fix the pulling part to the mounting groove.

What is claimed is:

1. A sealing cap comprising:

a cover part coupled to an upper side of a powder container and having a first area, a third area, a second area between the first and the third areas and an opening formed therein, wherein each of the first and the third areas is a horizontal area and the second area is a slope area; and a sealing part having a sealing body, a mounting groove and a pulling part formed therein, wherein the sealing body is attached to an upper surface of the cover part and covers the opening to seal the opening, wherein an outer edge of the sealing body is disposed on the upper surface of the cover part in the third area, wherein the mounting groove is formed as being recessed in a direction toward an inner space of the powder container at a point extended from the outer edge of the sealing body toward the opening, wherein the mounting groove has a deviation preventing part that a portion of the sealing body corresponding to a central area of the mounting area is projected upward, wherein an edge portion of an upper surface of the deviation preventing part is projected toward both side surfaces of the mounting groove, wherein the mounting groove has a bottom surface placed at a lower than a position of an upper surface of the sealing body and between an outer edge of the deviation preventing part and the side surfaces of the mounting groove, and wherein the pulling part is disposed on the bottom surface of the mounting groove and is placed at a lower than a position of the upper surface of the sealing body.

2. The sealing cap of claim 1, wherein a shape of deviation preventing part is formed of a T shape.

3. The sealing cap of claim 1, wherein the pulling part is in a shape of a ring having a hold hole formed therein.

4. The sealing cap of claim 1, further comprising a first finishing part that is formed by being bent downward from the cover part along the edge of the opening.

5. The sealing cap of claim 4, wherein the first finishing part is comprised of a downward portion bent downward from the edge of the opening, and a support portion bent outward of the opening from a lower end of the downward portion, and wherein, when a plurality of sealing caps is deposited, the support portion is brought into contact with a periphery of a sealing part of a lower sealing cap positioned under the sealing cap and thereby supported by the periphery of the sealing part of the lower sealing cap.

6. The sealing cap of claim 5, wherein a bottom surface of the mounting groove is placed at a position higher than a position of a lower surface of the first finishing part.

7. The sealing cap of claim 1, further comprising a second finishing part that is formed by being bent downward from one portion on an edge of the cover part along the edge of the cover part.

8. The sealing cap of claim 7, wherein a height of the second finishing part is equal to or greater than a height of the mounting groove.

9. The sealing cap of claim 1, wherein embo-shape forming processing has been performed on a portion of an area of the sealing body overlapping the opening.

* * * * *